US009470092B2

(12) United States Patent
Kurapati et al.

(10) Patent No.: US 9,470,092 B2
(45) Date of Patent: Oct. 18, 2016

(54) SYSTEM AND METHOD FOR ATTACHING A ROTATING BLADE IN A TURBINE

(71) Applicant: General Electric Company, Schenectady, NY (US)

(72) Inventors: Venkata Narasimha Rao Kurapati, Bangalore (IN); Kishore Kumar Somayajula, Bangalore (IN); Mahesh Gopalakrishnan, Bangalore (IN); Yagneshkumar Dalpatbhai Hathiwala, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 988 days.

(21) Appl. No.: 13/732,722

(22) Filed: Jan. 2, 2013

(65) Prior Publication Data

US 2014/0245752 A1 Sep. 4, 2014

(51) Int. Cl.
*F01D 5/14* (2006.01)
*F01D 5/30* (2006.01)

(52) U.S. Cl.
CPC ..... *F01D 5/14* (2013.01); *F01D 5/3007* (2013.01); *F01D 5/3053* (2013.01); *Y10T 29/49336* (2015.01)

(58) Field of Classification Search
CPC ..... F01D 5/30; F01D 5/3007; F01D 5/3023; F01D 5/303; F01D 5/3053; F01D 5/32; F01D 5/323; F01D 5/326
See application file for complete search history.

(56) References Cited

U.S. PATENT DOCUMENTS

| | | | | | |
|---|---|---|---|---|---|
| 2,790,620 | A * | 4/1957 | Rankin | F01D 5/3053 | 416/217 |
| 2,843,356 | A * | 7/1958 | Hull, Jr. | F01D 5/027 | 416/144 |
| 4,676,423 | A | 6/1987 | Ghibely | | |
| 4,676,723 | A * | 6/1987 | Kiger | F01D 5/326 | 416/193 A |
| 5,022,824 | A * | 6/1991 | Violette | B64C 11/008 | 416/230 |
| 5,102,302 | A * | 4/1992 | Schilling | B64C 11/04 | 416/134 A |
| 5,145,319 | A * | 9/1992 | Glowacki | F01D 5/3053 | 416/193 A |
| 5,409,353 | A * | 4/1995 | Imbault | F01D 5/3053 | 416/212 A |
| 7,442,011 | B2 | 10/2008 | Negulescu et al. | | |
| 2004/0037703 | A1* | 2/2004 | Arinci | F01D 5/32 | 416/220 R |
| 2011/0176923 | A1 | 7/2011 | Haffner | | |
| 2013/0243601 | A1* | 9/2013 | Floyd | F01D 5/284 | 416/220 R |

* cited by examiner

*Primary Examiner* — Jason Shanske
*Assistant Examiner* — Matthew T Largi
(74) *Attorney, Agent, or Firm* — Dority & Manning, PA

(57) ABSTRACT

A system for attaching a rotating blade in a turbine includes a bush having an axial slot and a radial slot that intersects with the axial slot. A radial retention member fits within the radial slot, and an axial retention member fits within the axial slot and engages with the radial retention member. A method for attaching a rotating blade in a turbine includes inserting a bush into an axial passage in a rotor wheel and inserting a radial retention member into a radial passage in the rotor wheel and through at least a portion of the bush. The method further includes inserting the rotating blade in a slot in the rotor wheel, inserting the radial retention member into a retention slot in the rotating blade, and inserting an axial retention member into the bush.

17 Claims, 6 Drawing Sheets

SYSTEM AND METHOD FOR ATTACHING A ROTATING BLADE IN A TURBINE

FIELD OF THE INVENTION

The present invention involves a system and method for attaching a rotating blade in a turbine.

BACKGROUND OF THE INVENTION

Turbines are widely used in a variety of aviation, industrial, and power generation applications to perform work. Each turbine generally includes alternating stages of peripherally mounted stator vanes and rotating blades. The stator vanes may be attached to a stationary component such as a casing that surrounds the turbine, and each stage of rotating blades may be attached to a different rotor wheel located along an axial centerline of the turbine. The multiple rotor wheels may connect together to form a rotor. In this manner, a compressed working fluid, such as steam, combustion gases, or air, may flow along a gas path through the turbine. The stator vanes accelerate and direct the compressed working fluid onto the subsequent stage of rotating blades to impart motion to the rotating blades, thus turning the rotor and performing work.

Various systems and methods have been developed to axially and radially retain the rotating blades in the rotor wheels while also facilitating repair and/or replacement of the rotating blades. For example, each rotating blade may include a root section that slides into a complementary-shaped dovetail or fir tree slot in the rotor wheel. A hammer or other instrument may be used to plastically deform the root section and/or rotor wheel to stake the rotating wheel in place. Although effective at axially and radially retaining the rotating blades, the area available for staking on the root section and/or rotor wheel is somewhat limited. As a result, the plastic deformation associated with the staking may become progressively more difficult after each repair and/or replacement of the rotating blades. Therefore, an improved system and method for attaching the rotating blade in the turbine would be useful.

BRIEF DESCRIPTION OF THE INVENTION

Aspects and advantages of the invention are set forth below in the following description, or may be obvious from the description, or may be learned through practice of the invention.

In one embodiment of the present invention, a system for attaching a rotating blade in a turbine includes a bush having an axial slot and a radial slot that intersects with the axial slot. A radial retention member fits within the radial slot, and an axial retention member fits within the axial slot and engages with the radial retention member.

Another embodiment of the present invention is a gas turbine that includes a compression section, a combustion section downstream from the compression section, and a turbine section downstream from the combustion section. A rotor wheel is in the turbine section. A plurality of rotating blades are connected to the rotor wheel. The gas turbine further includes means for preventing axial movement of each of the rotating blades with respect to the rotor wheel.

The present invention may also include a method for attaching a rotating blade in a turbine. The method includes inserting a bush into an axial passage in a rotor wheel and inserting a radial retention member into a radial passage in the rotor wheel and through at least a portion of the bush.

The method further includes inserting the rotating blade in a slot in the rotor wheel, inserting the radial retention member into a retention slot in the rotating blade, and inserting an axial retention member into the bush.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
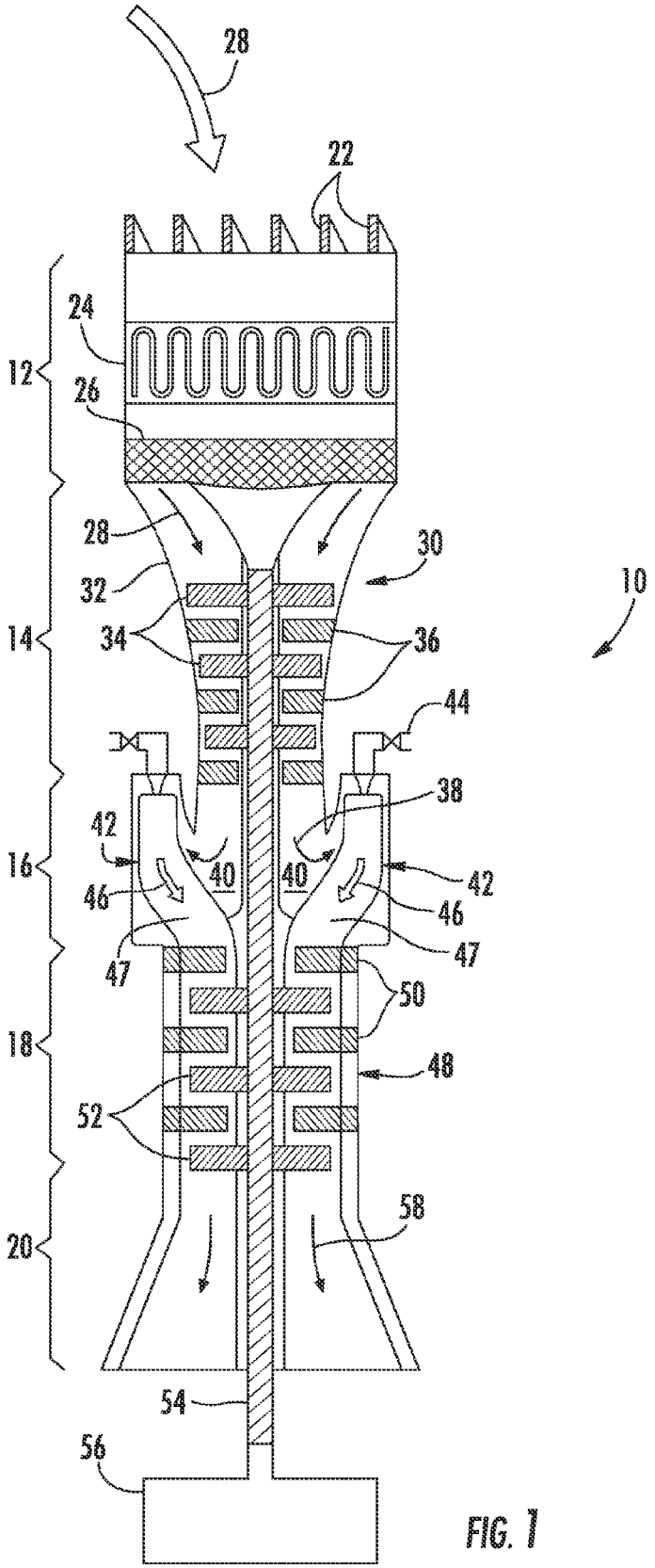
FIG. 1 is a simplified cross-section view of an exemplary gas turbine within the scope of various embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream," "downstream," "radially," and "axially" refer to the relative direction with respect to fluid flow in a fluid pathway. For example, "upstream" refers to the direction from which the fluid flows, and "downstream" refers to the direction to which the fluid flows. Similarly, "radially" refers to the relative direction substantially perpendicular to the fluid flow, and "axially" refers to the relative direction substantially parallel to the fluid flow.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a system and method for attaching a rotating blade in a turbine. The turbine generally includes a rotor wheel, and the rotating blade generally includes a root section that fits inside a complementary slot in the rotor wheel. The system and method generally include a bush that fits inside an axial passage in the rotor wheel, and a radial retention member fits inside a radial passage in the rotor wheel and simultaneously engages with the bush and a retention slot in the rotating blade. An axial retention member fits inside the bush to engage with the radial retention member and hold the radial retention member in place and engaged with the retention slot in the rotating blade. In particular embodiments, the axial retention member may fit inside at least a portion of the radial retention member. Although various exemplary embodiments of the present invention will be described in the context of a turbine incorporated into a gas turbine, one of ordinary skill in the art will readily appreciate from the teachings herein that the present invention is not limited to a gas turbine unless specifically recited in the claims.

Referring now to the drawings, wherein identical numerals indicate the same elements throughout the figures, FIG. 1 provides a simplified cross-section view of an exemplary gas turbine 10 within the scope of various embodiments of the present invention. As shown, the gas turbine 10 may generally include an inlet section 12, a compression section 14, a combustion section 16, a turbine section 18, and an exhaust section 20. The inlet section 12 may include a series of filters 22, one or more heat exchangers 24, moisture separators 26, and/or other devices to clean and otherwise condition a working fluid (e.g., air) 28 entering the gas turbine 10. The cleaned and conditioned working fluid 28 flows to a compressor 30 in the compression section 14. A compressor casing 32 contains the working fluid 28 as alternating stages of rotating blades 34 and stationary vanes 36 progressively accelerate and redirect the working fluid 28 to produce a continuous flow of compressed working fluid 38 at a higher temperature.

The majority of the compressed working fluid 38 flows through a compressor discharge plenum 40 to one or more combustors 42 in the combustion section 16. A fuel supply 44 in fluid communication with each combustor 42 supplies a fuel to each combustor 42. Possible fuels may include, for example, blast furnace gas, coke oven gas, natural gas, methane, vaporized liquefied natural gas (LNG), hydrogen, syngas, butane, propane, olefins, diesel, petroleum distillates, and combinations thereof. The compressed working fluid 38 mixes with the fuel and ignites to generate combustion gases 46 having a high temperature and pressure.

The combustion gases 46 flow along a hot gas path 47 through a turbine 48 in the turbine section 18 where they expand to produce work. Specifically, the combustion gases 46 may flow across alternating stages of stationary nozzles 50 and rotating blades 52 in the turbine 48. The stationary nozzles 50 redirect the combustion gases 46 onto the next stage of rotating blades 52, and the combustion gases 46 expand as they pass over the rotating blades 52, causing the rotating blades 44 to rotate. Each stage of rotating blades 52 may connect to a rotor or shaft 54 that is coupled to the compressor 30 so that rotation of the shaft 54 drives the compressor 30 to produce the compressed working fluid 46. Alternately or in addition, the shaft 54 may connect to a generator 56 for producing electricity. Exhaust gases 58 from the turbine section 18 flow through the exhaust section 20 prior to release to the environment. The exhaust section 20 may include, for example, additional filtration and a heat recovery steam generator (not shown) for cleaning and extracting additional heat from the exhaust gases 58 prior to release to the environment.

Figure 2:
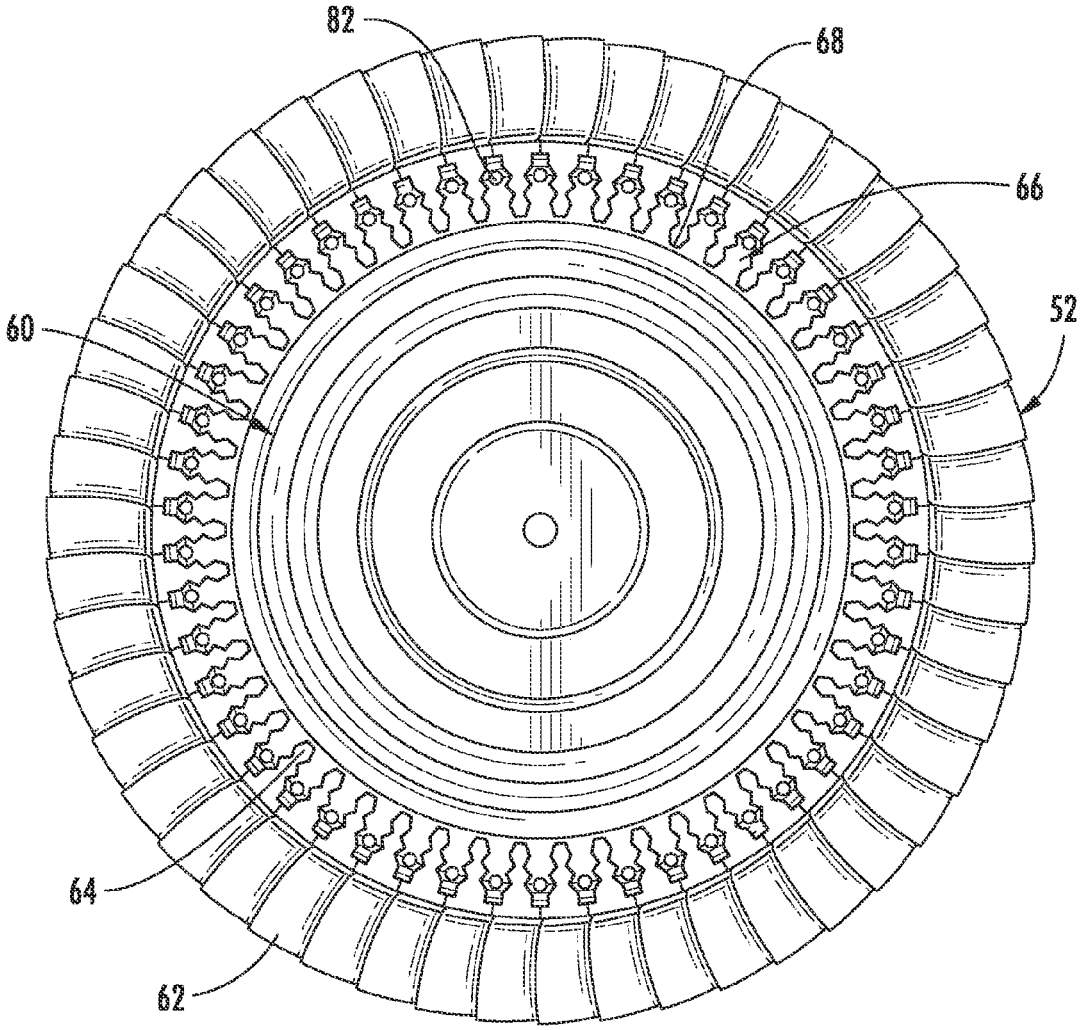
FIG. 2 is a downstream axial view of a stage of rotating blades shown in FIG. 1 according to one embodiment of the present invention.
Figure 3:
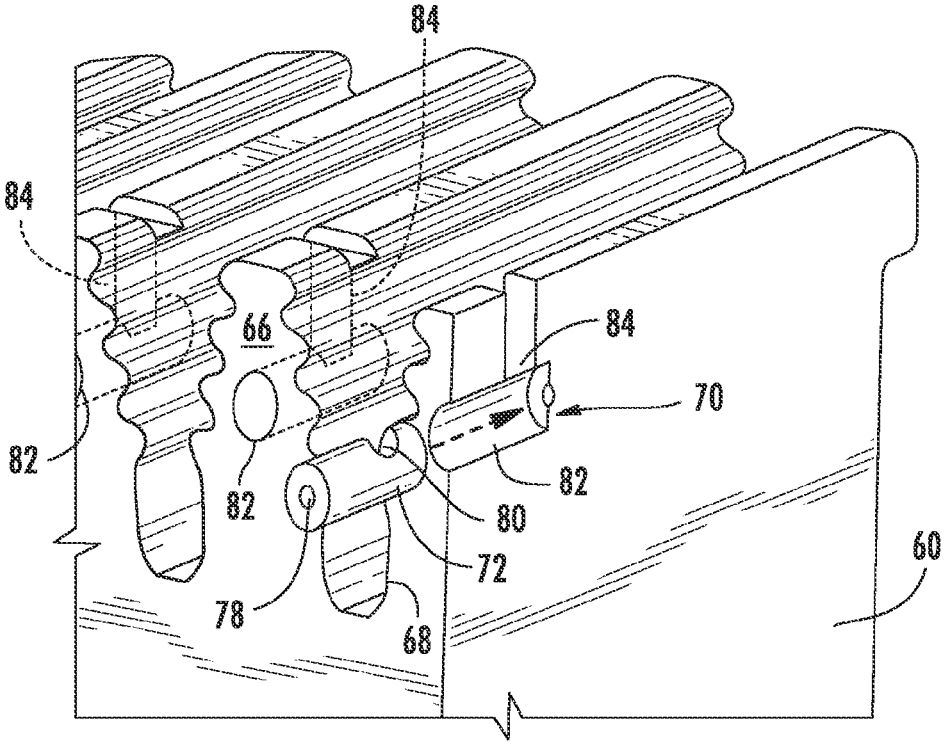
FIG. 3 is a perspective view of a system for attaching a rotating blade in a turbine according to one embodiment of the present invention.

The rotor or shaft 54 may include a separate rotor wheel 60 for each stage of stationary nozzles 50 and rotating blades 52, and FIG. 2 provides a downstream axial view of a stage of rotating blades 52 shown in FIG. 1 according to one embodiment of the present invention. As shown in FIG. 2, each rotating blade 52 may include an airfoil section 62 connected to a root section 64. In addition, the rotor wheel 60 may include posts 66 that separate a complementarily-shaped slot 68 for each root section 64. In this manner, the root section 64 of each rotating blade 52 may slide into the slot 68 to radially restrain each rotating blade 52.

FIGS. 3-7 provide perspective views of a system 70 for attaching the rotating blades 52 in the turbine 48 during various stages of assembly according to one embodiment of the present invention. As shown in FIGS. 3-7, the root section 64 of each rotating blade 52 may slide into the slot 68 to radially restrain each rotating blade 52, and the system 70 includes various means for preventing axial movement of each of the rotating blades 52 with respect to the rotor wheel 60. The function of the means is to restrain each rotating blade 52 from axial movement with respect to the rotor wheel 60. The structure for performing this function may include various combinations of detents, pins, screws, or other mechanical devices known to one of ordinary skill in the art for connecting components together. For example, in the particular embodiment shown in FIGS. 3-7, the structure for preventing axial movement of each of the rotating blades 52 with respect to the rotor wheel 60 may include a bush or first member 72, a radial retention member or second member 74, and an axial retention member or third member 76. Each member 72, 74, 76 may be cast, forged, or otherwise machined from low alloy steel, high alloy steel, or other suitable materials capable of withstanding the temperatures associated with the hot gas path 47 in the turbine 48. In addition, each member 72, 74, 76 may be generally cylindrical in shape with a circular cross-section along a width (W) and a rectangular cross-section along a length (L), with the cross-sectional area of the widths progressively decreasing between the first, second, and third members 72, 74, 76. In particular embodiments, one or more of the members 72, 74, 76 may be tapered. However, the particular geometry and cross-sectional areas of the first, second, and third members 72, 74, 76 are not limitations of the present invention unless specifically recited in the claims.

As shown in FIGS. 3-7, the bush or first member 72 may include an axial slot 78 that extends along the length and a radial slot 80 that extends along the width to intersect with the axial slot 78. The axial and radial slots 78, 80 may extend completely or partially through the bush 72, depending on the particular embodiment. As shown in FIGS. 3-7, each post 66 in the rotor wheel 60 may include an axial passage 82 that extends axially into each post 66 and a radial passage 84 that extends radially into each post 66 to intersect with the axial passage 82. During assembly, as shown most clearly in FIGS. 3 and 4, the bush 72 may be inserted into the axial passage 82 in the rotor wheel 60 so that the radial slot 80 in the bush 72 aligns with the radial passage 84 in the rotor wheel 60.

Figure 4:
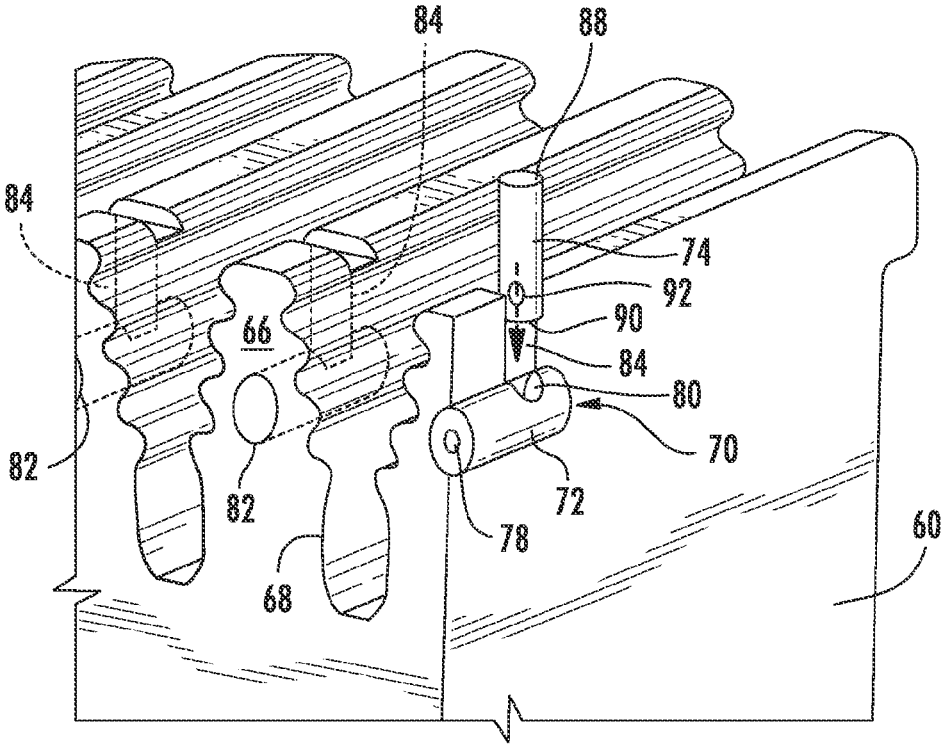
FIG. 4 is a perspective view of a system for attaching a rotating blade in a turbine according to one embodiment of the present invention.
Figure 5:
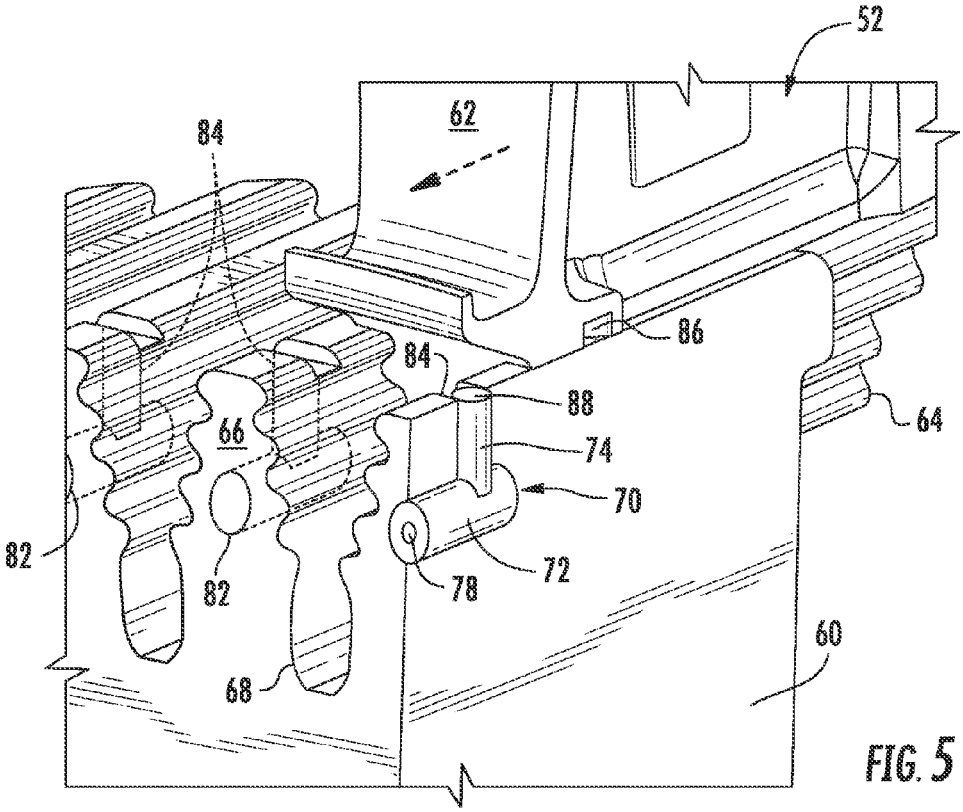
FIG. 5 is a perspective view of a system for attaching a rotating blade in a turbine according to one embodiment of the present invention.

Referring to FIGS. 4 and 5, the radial retention member or second member 74 may be inserted into the radial passage 84 to fit at least partially inside the radial slot 80 in the bush 72. As shown most clearly in FIGS. 5 and 6, the root section 64 of the rotating blade 52 may be inserted into the slot 68 in the rotor wheel 60 until a retention slot 86 in the rotating blade 52 aligns with the radial passage 84 in the post 66. The radial retention member 74 may then be partially withdrawn from the radial slot 80 and radial passage 84 so that a first end 88 of the radial retention member 74 engages with the retention slot 86 in the rotating blade 52 while a second end 90 of the radial retention member 74 remains engaged with the bush 72. For example, the rotor wheel 60 may be rotated to invert the radial retention member 74 and allow gravity to partially withdraw the radial retention member 74 from the radial slot 80 and radial passage 84 so that the first end 88 of the radial retention member 74 fits inside the retention slot 84 in the rotating blade 52. Alternately, magnetic force may be applied to the radial retention member 74 to partially withdraw the radial retention member 74 into the retention slot 86 in the rotating blade 52.

Figure 6:
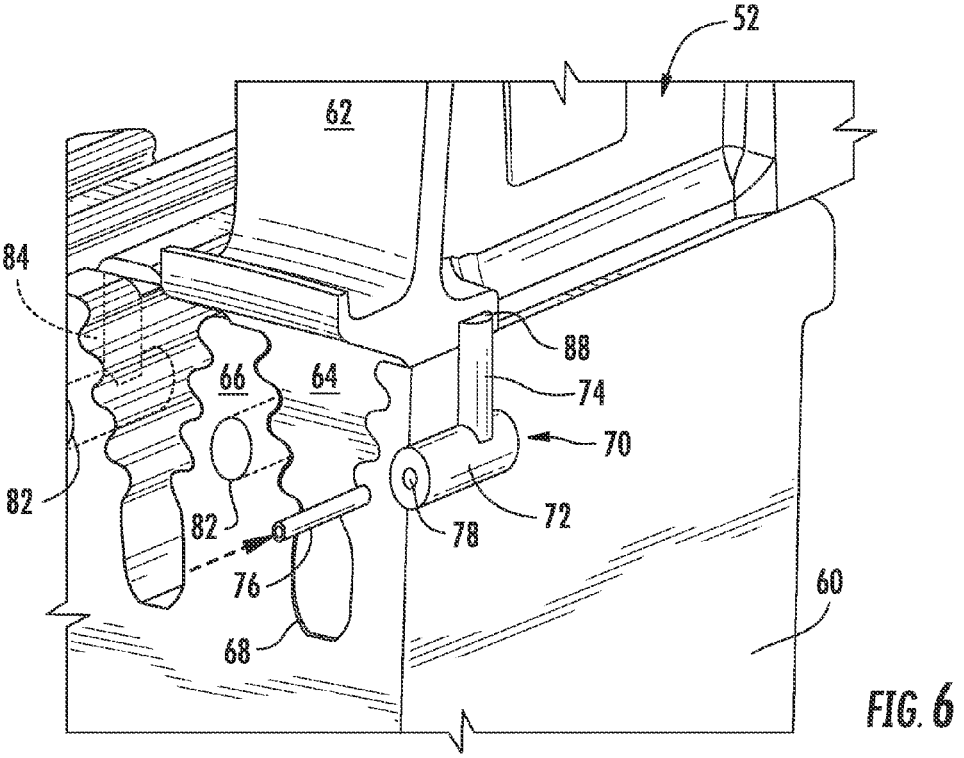
FIG. 6 is a perspective view of a system for attaching a rotating blade in a turbine according to one embodiment of the present invention.
Figure 7:
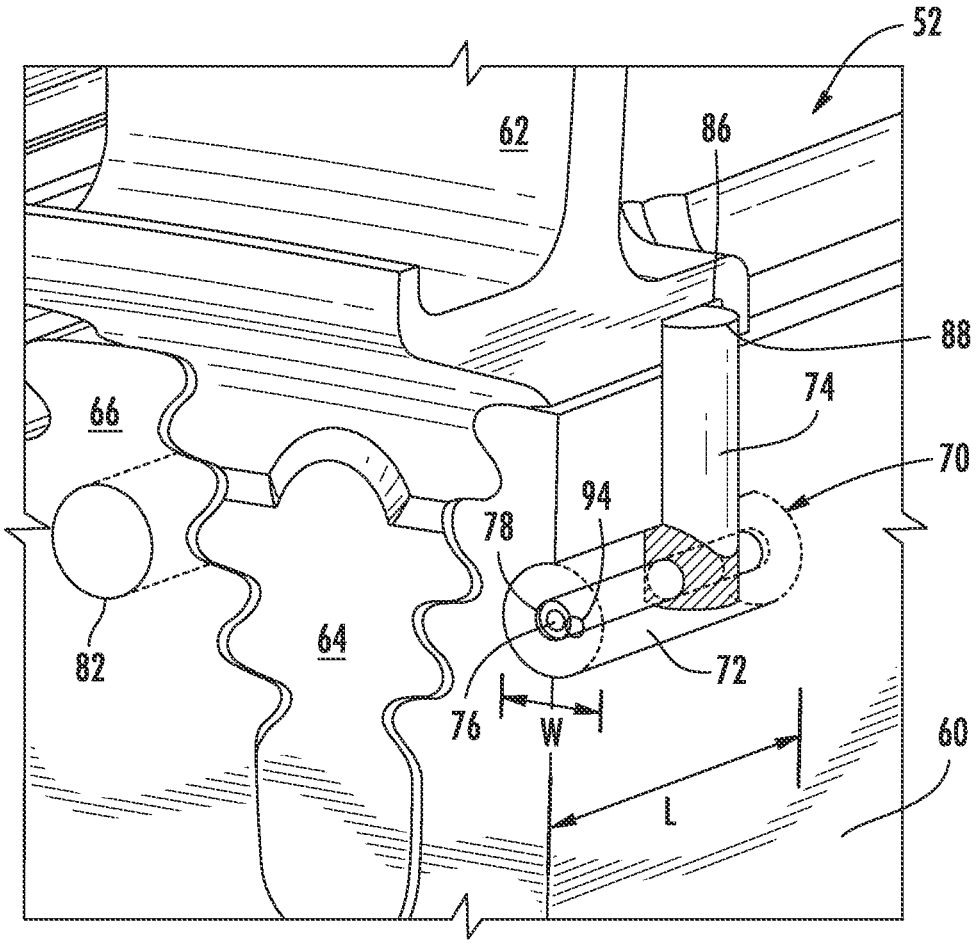
FIG. 7 is a perspective view of a portion of the stage of rotating blades shown in FIG. 2 attached to the rotor wheel.

Once the radial retention member 74 is engaged with the retention slot 86 in the rotating blade 52, the axial retention member or third member 76 may be inserted into the axial slot 78 to engage with the radial retention member 74, as shown in FIGS. 6 and 7. In particular embodiments, the axial retention member 76 may slide beneath the radial retention member 74 to prevent the radial retention member 74 from dropping back into the radial slot 80. Alternately, as shown most clearly in FIGS. 4 and 7, the radial retention member 74 may include a bore hole 92, and the axial retention member 76 may fit inside at least a portion of the radial retention member 74 to securely hold the radial retention member 74 engaged with the retention slot 86 in the rotating blade 52. In this manner, the bush or first member 72 remains engaged with the rotor wheel 60, and the radial retention member or second member 74 remains simultaneously engaged with both the bush or first member 72 and the retention slot 86 in the rotating blade 52 to prevent axial movement of the rotating blade 52 with respect to the rotor wheel 60.

Referring to FIG. 7, the means for preventing axial movement of each of the rotating blades 52 with respect to the rotor wheel 60 may further include staking the axial retention member 76 in the bush 72, represented by reference number 94 in FIG. 7. Specifically, the axial retention member 76 and/or bush 72 may be plastically deformed to prevent inadvertent movement of the axial retention member 76 during operation of the turbine 48. In this manner, the axial retention member 76 and/or bush 72 may be repeatedly staked and/or replaced as necessary without altering or damaging either the root section 64 of the rotating blade 52 or the post 66 of the rotor wheel 60.

Figure 8:
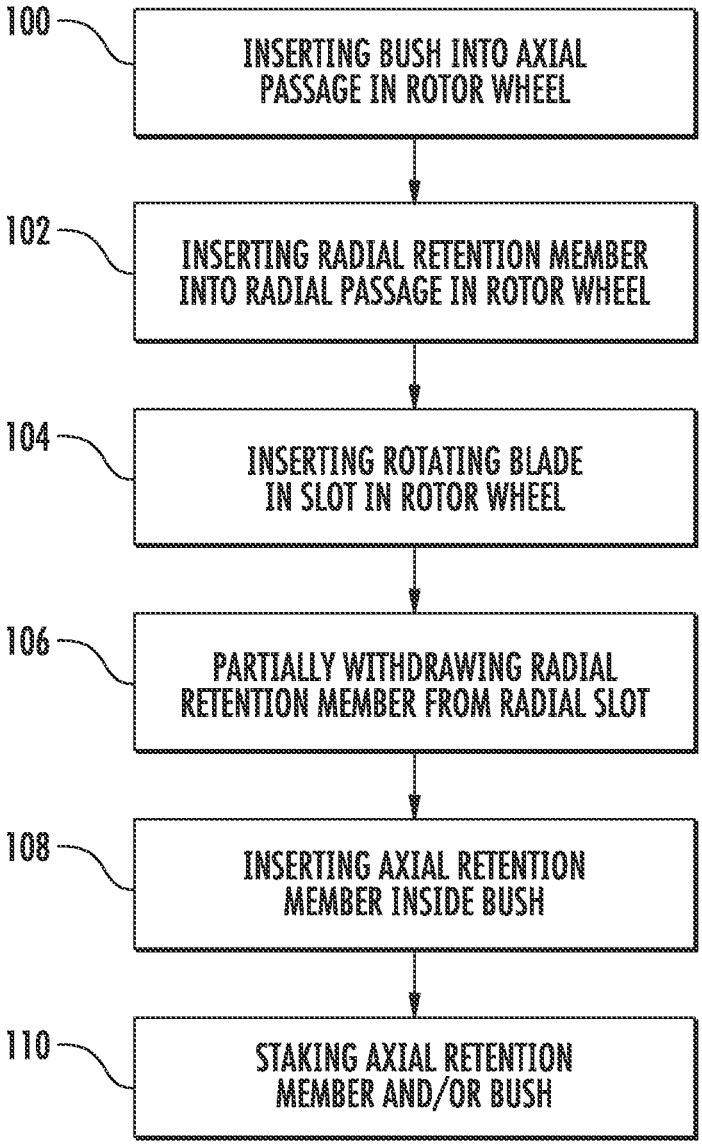
FIG. 8 is a flow diagram of a method for attaching a rotating blade in a turbine according to one embodiment of the present invention.

FIG. 8 provides a flow diagram of a method for attaching the rotating blade 52 in the turbine 48 as previously described with respect to FIGS. 3-7. At block 100, the method may include inserting the bush or first member 72 into the axial passage 82 in the rotor wheel 60, as previously described with respect to FIG. 3. At block 102, the method may include inserting the radial retention member or second member 74 into the radial passage 84 in the rotor wheel 60 and through at least a portion of the bush 72, as previously described with respect to FIGS. 4 and 5. At block 104, the method may include inserting the rotating blade 52 in the slot 66 in the rotor wheel 60 until the retention slot 86 in the rotating blade 52 aligns with the radial passage 84 in the post 66, as previously described with respect to FIGS. 5 and 6.

At block 106, the method may include partially withdrawing the radial retention member 74 from the radial slot 80 and radial passage 84 so that the first end 88 of the radial retention member 74 engages with the retention slot 86 in the rotating blade 52 while the second end 90 of the radial retention member 74 remains engaged with the bush 72. In particular embodiments, this step may include magnetically withdrawing the radial retention member 74 from the radial slot 80 and radial passage 84. In other particular embodiments, this step may include rotating the rotor wheel 60 to invert the radial retention member 74 and allow gravity to partially withdraw the radial retention member 74 from the radial slot 80 and radial passage 84.

At block 108, the method may include inserting the axial retention member or third member 76 inside at least a portion of the bush 72, as previously described with respect to FIGS. 6 and 7. At block 110, the method may include staking the axial retention member 76 and/or the bush 72 to prevent inadvertent movement of the axial retention member 76 during operation of the turbine 48.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A system for attaching a rotating blade in a turbine, comprising:

a. a rotor wheel defining an axial passage and a radial passage that intersects with said axial passage;

b. a bush seated within said axial passage;

c. an axial slot in said bush;

d. a radial slot in said bush, wherein said radial slot intersects with said axial slot, wherein said radial slot is coaxially aligned with said radial passage;

e. a radial retention member seated within said radial passage and said radial slot of said bush; and f. an axial retention member seated within said axial slot and engaged with said radial retention member within said axial slot of said bush.

2. The system as in claim 1, wherein said axial retention member defines a bore hole, wherein said bore hole is coaxially aligned with said axial slot of said bush, wherein said axial retention member extends at least partially through said bore hole.

3. The system as in claim 1, wherein said radial retention member has a first end that fits inside a retention slot in the rotating blade and a second end that is seated inside said radial slot.

4. The system as in claim 1, wherein said radial slot extends inside said bush a distance of less than a cross-section of said bush.

5. The system as in claim 1, wherein said radial retention member has an equal or larger cross-sectional area than said axial retention member.

6. The system as in claim 1, wherein said bush has a circular or rectangular or polygonal cross-section.

7. A gas turbine, comprising:

a. a compression section;

b. a combustion section downstream from the compression section;

c. a turbine section downstream from the combustion section;

d. a rotor wheel in the turbine section, wherein the rotor wheel defines an axial passage and a radial passage that intersects with the axial passage;

e. a plurality of rotating blades connected to the rotor wheel; and f. a system for attaching at least one rotating blade of the plurality of rotating blades to the rotor wheel, the system comprising:

i. a bush seated within the axial passage;

ii. an axial slot in the bush;

iii. a radial slot in the bush, wherein the radial slot intersects with the axial slot, wherein the radial slot is coaxially aligned with the radial passage;

iv. a radial retention member seated within the radial passage and the radial slot; and v. an axial retention member seated within the axial slot and engaged with the radial retention member within the axial slot of the bush.

8. The gas turbine as in claim 7, wherein the axial retention member defines a bore hole, wherein the bore hole is coaxially aligned with the axial slot of the bush, wherein the axial retention member extends at least partially through the bore hole.

9. The gas turbine as in claim 7, wherein the radial retention member has a first end that fits inside a retention slot in the rotating blade and a second end that is seated inside the radial slot.

10. The gas turbine as in claim 9, wherein the radial slot extends inside the bush a distance of less than a cross-section of the bush.

11. The gas turbine as in claim 10, wherein said bush has a circular or rectangular or polygonal cross-section.

12. The gas turbine as in claim 10, wherein the axial retention member defines a bore hole, wherein the bore hole is coaxially aligned with the axial slot of the bush, wherein the axial retention member extends through the bore hole.

13. The gas turbine as in claim 10, wherein the radial retention member has an equal or larger cross-sectional area than the axial retention member.

14. A method for attaching a rotating blade in a turbine, comprising:

a. inserting a bush defining an axil slot into an axial passage in a rotor wheel, wherein the bush defines a radial slot coaxially aligned with a radial passage defined by the rotor wheel;

b. inserting a radial retention member into the radial passage and into the radial slot of the bush, wherein the radial retention member defines a bore hole coaxially aligned with the axial slot of the bush;

c. inserting the rotating blade in a slot in the rotor wheel;

d. rotating the rotor wheel to invert the radial retention member such that the radial retention member slides into a retention slot in the rotating blade; and e. inserting an axial retention member into the bush, wherein the axial retention member extends at least partially through the bore hole defined by the radial retention member.

15. The method as in claim 14, further comprising staking the axial retention member in the bush.

16. The method as in claim 14, further comprising inserting the axial retention member axially through the radial retention member.

17. The method as in claim 14, further comprising inserting the radial retention member a distance of less than a cross-section of the bush.

* * * * *